US005533534A

United States Patent [19]

Cariello et al.

[11] Patent Number: 5,533,534

[45] Date of Patent: Jul. 9, 1996

[54] TOWEL SHOWER ORGANIZER

[76] Inventors: Carolyn Cariello; Frank Cariello, both of 41 Dow Ave., Red Bank, N.J. 07701

[21] Appl. No.: 364,540

[22] Filed: Dec. 27, 1994

[51] Int. Cl.[6] ..... A45D 40/00; A47F 7/08

[52] U.S. Cl. ..... 132/286; 132/314; 211/35; 211/34; 211/38

[58] Field of Search ..... 248/209.1; 132/286, 132/314, 294; 211/35, 38, 34

[56] References Cited

U.S. PATENT DOCUMENTS 1,447,636 3/1923 White ..... 211/35

2,359,372 10/1944 Leader ..... 211/35

4,585,127 4/1986 Benedict ..... 211/34

*Primary Examiner*—John G. Weiss

*Assistant Examiner*—Pedro Philogene

*Attorney, Agent, or Firm*—Charles I. Brodsky

[57] ABSTRACT

An easily manufactured, inexpensive shower accessory that holds various toiletries in an organized method so as to be easily accessible during bathing, and is made out of an attractive toweling material, such as terry-cloth, so as to coordinate with other towels and decor of the bathroom in which the shower is located, and to be easily washable and resistant to mildewing, corrosion, and destruction.

10 Claims, 1 Drawing Sheet

TOWEL SHOWER ORGANIZER

FIELD OF THE INVENTION

This invention relates to toiletry accessories and, more particularly, to a shower accessory which makes access to toiletries more organized, convenient, and attractive than existing methods of toiletry storage.

BACKGROUND OF THE INVENTION

As is well known, bath tubs and shower stalls have become increasingly cluttered with toiletries as the beauty and hair care products market has expanded its products lines for both men and women. It is not unusual to find the perimeter of a tub or shower stall cluttered with various shampoos, conditioners, razors, shaving creams, loofas, and soaps. As a consequence it often occurs that any or all of these products fall into the bathing area, causing the bather to bend and retrieve the item, or worse, to step on and break the item or slip on it. To deal with this problem, others in the field have offered shower organizers which hang off of various fixtures in the bathroom, e.g. the shower head, the soap dish, or the curtain rod, with some of these organizers being constructed out of a rigid wire, rigid plastic, flexible plastic, or netting material.

In the case of the organizers constructed out of wire, a few problems exist: a) the wiring will eventually rust and corrode, thereby becoming unsightly and potentially dangerous if and when it breaks—leaving sharp pointed ends; b) the rigid form and multiplicity of surfaces also makes it difficult to clean, which usually results in it not being done; and c) the format usually comprises a wire shelf with a retaining wall around it so as to prevent toiletries from falling to the floor, but does not provide separate compartments for each toiletry—thereby allowing them to tip over within the shelf and become difficult to grab and possibly leak.

The organizers made out of rigid plastic, similarly, have much the same problems (with the exception of the possibility of rust and corrosion) yet are susceptible to cracking—thereby exposing the bather to sharp edges; also mildew becomes a problem since the plastic shelf retains some of the water from the shower and does not lend to self-drying, or rinsing.

As will be understood the dangerous aspects of these rigid organizers, and their lack of separate compartments, are not present in those organizers constructed out of flexible plastic or netting—whose format generally consists of a flimsy sheet which hangs on the curtain rod by means of hooks or rings, and whose surface is covered with a series of pockets which are vertically situated. However, in the case of organizers constructed out of flexible plastic, mildew becomes a much larger problem than with the prior alternatives, in which the pockets that hold the toiletries retain water between sheets of non-breathing material (plastic) and allows mold and bacteria to form and the plastic to rot and tear. On the other hand, organizers that are constructed out of mesh netting do not have the problems associated with rigid designs, or of flexible plastic designs since they are easily cleaned—thereby eliminating mildew, and being soft have no dangerous edges, but they are fairly flimsy and easily snagged and torn; also, due to their lack of rigidity,—a problem with the flexible plastic organizers as well—they tend to sag under the weight of the toiletries and makes access more difficult, especially considering their typical uniformity-of-pocket-sizes without consideration of the different bulks of the various toiletries to be contained.

And, as will be appreciated, two additional problems run throughout each incarnation of these prior art shower organizers: a) that they are either unattractive, or not coordinated with the rest of the bathroom decor; b) that the manufacturing process is complicated and costly.

OBJECTS OF THE INVENTION

It is the object of the present invention to provide a new, inexpensive, lightweight, organized method of organizing and having within reach toiletries to be used in the shower or tub, which will overcome the limitations of these prior arrangements.

It is another object of the present invention to substantially reduce the amount of time needed to clean shower organizers, so as to reduce the occurrence of mildew formation.

It is also an object of the invention to provide a shower organizer to attend to this, and in a manner so as to prevent against misplaced, dropped, or broken toiletries, thereby saving time, energy, risk of injury, and money to the bather.

It is a further object of the invention to provide an attractive organizer that can match with the toweling that the user selects for the bathroom decor, by constructing the organizer out of the same toweling material as selected for the other bathroom needs.

It is a final object of the invention to significantly reduce the cost of the manufacturing process by reducing the product to a single sheet of material which only requires straight line stitching, and button holing, to transform it into the final product.

SUMMARY OF THE INVENTION

As will become clear from the description that follows, the shower organizer of the invention preferably is in the nature of a decoratively attractive, inexpensively priced vertically hung towel designed to hold a multiplicity of toiletries in an organized, easily accessible fashion to bathers during the course of showering. As will also become clear, the organizer of the invention may be, generally constructed in the form of a towel which, when properly folded and stitched, forms in excess of 8 pockets of varying dimensions, arranged for vertical orientation by being readily attachable and removable from an existing curtain rod, or shower door bar. As will further become clear, an organizer embodying the invention may be selected of such toweling material (as Terry-cloth, for example) to be of a sufficient strength to maintain its shape, dimension, and look, while its pockets are being utilized. In a preferred embodiment, a series of reinforced button-holes may be located along the top edge of the organizer to allow it to be attached to existing shower curtain rings, or similar hooks to connect to a shower door bar.

BRIEF DESCRIPTION OF THE DRAWING

These and other features of the invention will be more clearly understood from a consideration of the following description, taken in connection with the accompanying drawing, in which.

DETAILED DESCRIPTION OF THE DRAWING

FIGS. 1–4 show a preferred embodiment of the invention.

Figure 1:
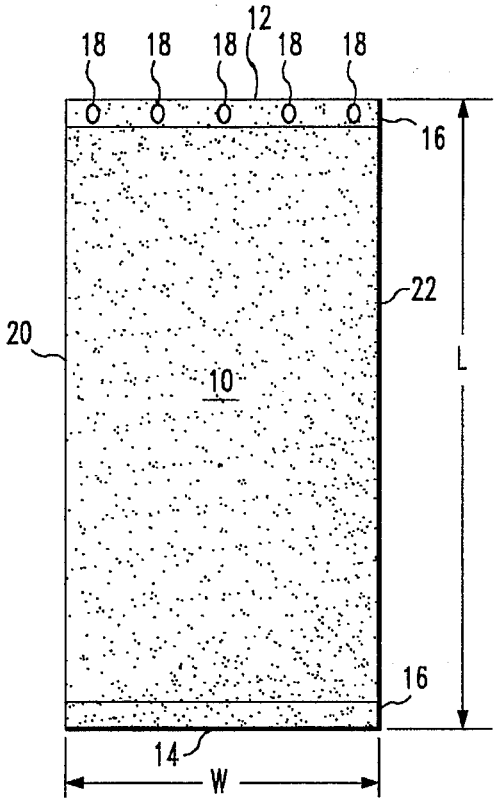
FIG. 1 is a front view of a manufactured towel in which reinforced buttonholes have been added to the top reinforced edge.

In FIG. 1, a manufactured bath towel 10, preferably of terry-cloth, is shown having a width W, of 27 inches and a length L, of 52 inches. Along its top edge 12, and bottom edge 14, are a 1 inch high reinforcing strip 16, which extends for the entire width of the towel W, to prevent the fraying of its edges. Additionally, along the reinforced top edge 12, are reinforced button holes 18, the first being 1.5 inches in from the left edge of the towel 20, and the remaining ones being each separated by 6 inches as they are laid out along the strip 16 towards the right edge of the towel 22, with the last being 1.5 inches in from the right edge 22.

Figure 2:
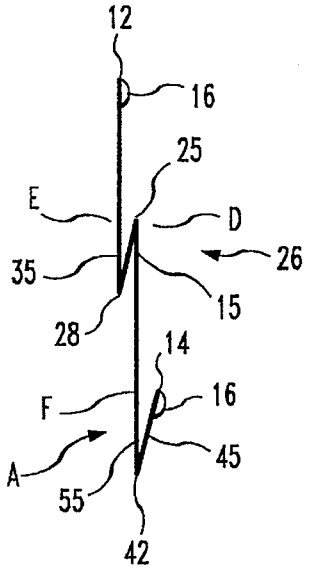
FIG. 2 is a side view of the towel of FIG. 1, showing an S-fold, bottom fold, and reinforced top and bottom edges in carrying out the teachings of the invention.
Figure 3:
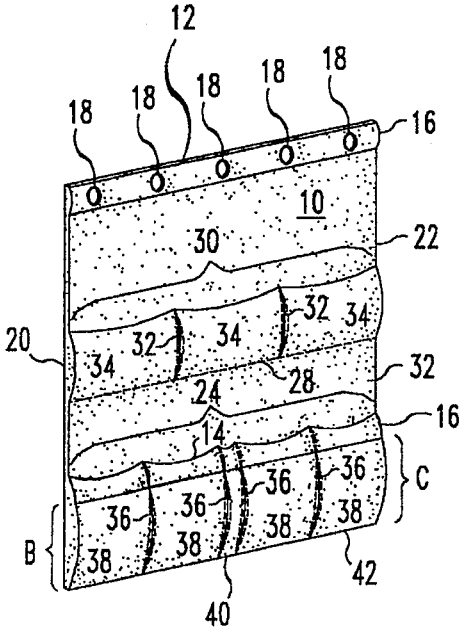
FIG. 3 is a front perspective view of a towel shower organizer embodying the principles of the present invention.

In FIG. 2, the towel 10 is shown folded in accordance with the invention, whereby the bottom edge 14 is folded forwards and upwards (as at A) a distance of 8 inches where it is then stitched along the left edge 20 and right edge 22 of the towel (as at B and C in FIG. 3). In such manner, the front and back surfaces of the fold 45, 55 establish an open bottom pocket 24 which extends across the entire width W. To form a second pocket 30 for the storage of more toiletries, at a level higher than the lower pocket 24, an S-fold 26 is used. In particular, the towel 10 is first folded forward and upward a distance of 7 inches (as at D), beginning at a point some 18 inches below the top edge 12, and then folding the towel 10 downward upon itself, as at E. The three resulting surfaces of toweling 15, 25, 35 are then stitched along the left edge 20 and right edge 22, where they overlap, and along the width W, at the fold line 28, thereby forming another open pocket 30, which extends across the width W.

Figure 4:
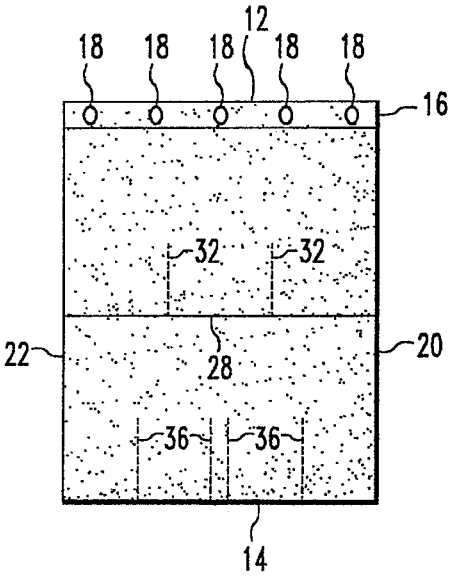
FIG. 4 is back view of the towel shower organizer, showing the stitching that forms partitions in the organizer's pockets.

The resulting folded towel 10, with upper pocket 30, and lower pocket 24 is shown in FIGS. 3 and 4, along with a 4 inch space 32 between the two to permit access to the lower pocket 24. The pocket 30 is shown as being further provided with stitching 32, to divide it into three compartments 34 of 9 inch width—each in particular by a stitching which joins the top surface of toweling 15 to the other two surfaces 25, 35. Such stitching, for example, may extend from the fold line 28 upwardly towards the point E of FIG. 2, beginning some 9 inches inwards from either edge 20, 22. The lower pocket 24 may similarly be divided by stitching 36 into five compartments—four 5 inch wide compartments 38, and one 1 inch wide compartment 40—by a stitching which joins front surface 45 to the back surface 55, and which may extend upwardly from the fold line 42 through the bottom edge 14 towards the point F of FIG. 2. In this embodiment, the left-most stitching 36 begins some 6.5 inches in from the left edge 20, the next stitching 36 is formed 6.5 inches to its right, the next stitching 36 one inch to the right still further—and then two more stitchings 36, the first displaced one more inch to the right, and the second, or right-most stitching 36, located 6.5 inches in from the right edge 22.

In use of the invention, when a shopper is purchasing his or her bathroom accessories,—such as towels, shower curtains, and bath mats the shopper can select a shower organizer made of the same material, color, and pattern as the rest of the accessories either bundled as a set or individually—and be able to purchase totally coordinating decor. To set it up, the user simply hangs the towel shower organizer on the inside of the shower—on the shower curtain with the existing rings that hold up the shower curtain. The user simply opens up 5 of the shower curtain rings and inserts them through the reinforced buttonholes 18, then locking the rings back in place. If there is no curtain rod present, the organizer can easily be attached to the shower door bar by means of included or separately purchased curtain rings. Once the organizer is hung, the user fills its compartments with the various toiletries had, the taller of which may go into the lower pocket compartments 38, since they are deeper, with the only exception being the 1 inch center compartment 40, (which is more suitable for razors, or toothbrushes). The bulkier toiletry articles may similarly be put into the upper pocket compartments 34, as they are wider. When the shower organizer becomes soiled, or the user is doing a wash load of other towels, the organizer may be readily removed and tossed in the washer and dryer along with the rest of the load.

While there have been described what are considered to be preferred embodiments of the present invention, it will be readily appreciated by those skilled in the art that modifications can be made without departing from the scope of the teachings herein. Thus, whereas, a 2 level organizer has been depicted, it will be appreciated that any number of levels can be employed depending upon the length of the toweling and the depth of the compartments desired. Additionally, while an 8 compartment layout has been described, it will be understood that more or less than 8 compartments may be employed and still carry out the principles underlying the invention. For at least such reasons, therefore, resort should be had to the claims appended hereto for a true understanding of the scope of the invention.

We claim:

1. A shower organizer for holding shampoo, conditioner and like toiletries for shower and bathtub usage comprising: a sheet of toweling material having a front surface and a rear surface; a multiplicity of compartments formed in said front surface; and means for removably coupling said sheet to a shower curtain rod or shower door bar, with said rear surface being adjacent to said rod or bar in use, and therein said sheet of toweling material is selected of a material to be self-drying, washable, driable and mildew-resistant; and wherein a bottom of said toweling sheet is folded forward and upward upon itself a distance of substantially 8 inches to form a first fold having opposite side edges, an upper edge, a bottom edge and top and bottom layers, and wherein stitching is included along said opposite side edges to form a lower pocket equaling the width of said toweling sheet, and with the entire length of said upper edge being open.

2. The shower organizer of claim 1 wherein said toweling material is composed of a Terry-cloth material.

3. The shower organizer of claim 1 wherein at least one of said multiplicity of compartments is of a different dimension than others of said multiplicity of compartments.

4. The shower organizer of claim 1, wherein the smallest of said compartments is of a width of 1 inch.

5. The shower organizer of claim 1 wherein 8 compartments are formed in said front surface of said toweling sheet.

6. The shower organizer of claim 5, wherein the largest of said compartments is of a width equal to substantially one-third the width of said toweling sheet.

7. The shower organizer of claim 1, also including a multiplicity of reinforced holes along a top edge of said sheet for attachment to a shower curtain rod or shower door bar.

8. The shower organizer of claim 1, also including stitching between said top and bottom layers of said first fold, starting at said bottom edge of said fold, and continuing upwardly towards said upper edge of said fold, to form individual ones of said compartments in said lower pocket.

9. The shower organizer of claim 8, wherein a further portion of said toweling sheet is folded first forward and upward-upon itself a distance of substantially 7 inches to form a second fold having opposite side edges, an upper edge, a bottom edge and top and bottom layers, and wherein additional stitching is included along said opposite side edges of said second fold to form an upper pocket equalizing the width of said toweling sheet, and with the entire length of said upper edge of said second fold being open.

10. The shower organizer of claim 9, also including stitching between said top and bottom layers of said second fold, starting at said bottom edge of said second fold, and continuing upwardly toward said upper edge of said second fold, to form individual ones of said compartments in said upper pocket.

* * * * *